US007566147B2

(12) United States Patent
Wilcox et al.

(10) Patent No.: US 7,566,147 B2
(45) Date of Patent: Jul. 28, 2009

(54) MULTI-LED LIGHT FIXTURE WITH SECURE ARRANGEMENT FOR LED-ARRAY WIRING

(75) Inventors: Kurt S. Wilcox, Libertyville, IL (US); Wayne Guillien, Franksville, WI (US)

(73) Assignee: Ruud Lighting, Inc., Racine, WI (US)

( * ) Notice: Subject to any disclaimer, the term of this patent is extended or adjusted under 35 U.S.C. 154(b) by 0 days.

(21) Appl. No.: 11/744,750

(22) Filed: May 4, 2007

(65) Prior Publication Data

US 2008/0273326 A1 Nov. 6, 2008

(51) Int. Cl.
*F21V 21/00* (2006.01)

(52) U.S. Cl. ..... 362/249; 362/240; 362/370; 362/800

(58) Field of Classification Search ..... 362/240, 362/249, 370, 431, 800, 368, 369, 371; 313/500
See application file for complete search history.

(56) References Cited

U.S. PATENT DOCUMENTS 4,254,453 A 3/1981 Mouyard et al.
6,758,580 B1 7/2004 Verfuerth
6,942,360 B2 9/2005 Chou et al.
6,942,361 B1 * 9/2005 Kishimura et al. ..... 362/240
2002/0113244 A1 8/2002 Barnett et al.

OTHER PUBLICATIONS

Lithonia LIghting. Installation Instructions—Single and Twin Mounting Bar (RJ5210060). Date: Jun. 1999.
Lithonia Lighting. Industrial Accessories—Wireguards Accessories (ACCI). Date: 1999.
W.A.C. Lighting. W.A.C. Lighting Catalog (e.g., cover, pp. 3, 5-6, 16, 23, 34). Date: 1998.

* cited by examiner

*Primary Examiner*—Stephen F Husar
(74) *Attorney, Agent, or Firm*—Jansson Shupe & Munger Ltd.

(57) ABSTRACT

In an embodiment of an LED light fixture, the fixture includes a housing defining a chamber and an LED module that is outside the chamber and adjacent to the housing. The LED module includes a mounting board with a plurality of LED packages mounted thereon and a cover over the mounting board. The cover and the mounting board together form a module interior and the cover is configured to expose the LED packages. The improvement in this light fixture includes a rigid wireway between the LED module and the housing and defining a passageway between the module interior and the chamber.

9 Claims, 4 Drawing Sheets

MULTI-LED LIGHT FIXTURE WITH SECURE ARRANGEMENT FOR LED-ARRAY WIRING

FIELD OF THE INVENTION

This invention is related generally to LED light fixtures and, more particularly, to multi-LED light fixtures with their attendant complex wiring to serve the multiple LEDs of LED arrays.

BACKGROUND OF THE INVENTION

In the field of lighting, many different types of light sources have been developed. Recently, LED light sources involving multi-LED arrays, each with a large number of LED packages, have been developed as a means of bringing the many advantages of LED lighting—LED efficiency and long life—into the general illumination field. In particular, such LED light fixtures have been developed for use in outdoor settings, including by way of example lighting for parking lots, roadways, display areas and other large areas.

Because of the large number of LEDs involved in such LED light fixtures, secure wiring and protecting wiring from the environment are particular concerns. And, given the large heat dissipation from multi-LED modules in such systems, water-tight enclosure of LED modules is undesirable, thereby potentially exacerbating the problem of protecting multiple wires and connections from the elements. Because the wiring from LED modules must be routed into a preferably water-tight housing that encloses electronic elements such as LED drivers and, because a great number of wires are involved, providing proper organization and sealing engagement can be problematic.

OBJECTS OF THE INVENTION

It is an object of the invention to provide an improved light fixture utilizing LED light sources that overcomes some of the problems and shortcomings of the prior art, including those referred to above.

Another object of the invention is to provide an improved light fixture utilizing LED light sources that provides a secure connection between the LED module and the housing.

Another object of the invention is to provide an improved light fixture utilizing LED light sources that provides a continuous sealed environment for the LED module and housing.

Another object of the invention is improved light fixture utilizing LED light sources that provides a universal cover piece with an integral rigid wireway that can be fitted to a variety of housing units.

Another object of the invention is to provide a wireway for the large number of wires needed for a multi-LED array light fixture.

How these and other objects are accomplished will become apparent from the following descriptions and the drawings.

SUMMARY OF THE INVENTION

In an embodiment of an LED light fixture, the fixture includes a housing defining a chamber and an LED module that is outside the chamber and adjacent to the housing. The LED module includes a mounting board with a plurality of LED packages mounted thereon and a cover over the mounting board. The cover and the mounting board together form a module interior and the cover is configured to expose the LED packages. The improvement in this light fixture includes a rigid wireway between the LED module and the housing and defining a passageway between the module interior and the chamber.

In a second embodiment, the LED light fixture includes a rigid wireway that is integral with the LED module.

In another embodiment the housing of the LED light fixture has an aperture and the wireway includes a distal end in sealing engagement about the aperture.

In yet another embodiment the rigid wireway of the LED light fixture is integral with the cover.

In a further embodiment the passageway of the LED light fixture between the interior and the chamber is water-tight.

In a still further embodiment the cover of the LED light fixture includes a main planar portion and an edge portion therearound and extending toward the mounting board. The integrally-formed rigid wireway extends from the edge portion toward the housing.

In another embodiment the LED light fixture includes a gasket layer disposed within the module interior and is configured to expose the LED packages. In a modification of this embodiment the gasket layer is a sponge layer.

The phrase "integral with the LED module" means integral with any individual piece of the LED module or integral with multiple pieces.

DETAILED DESCRIPTION OF THE PREFERRED EMBODIMENTS

Figure 1:
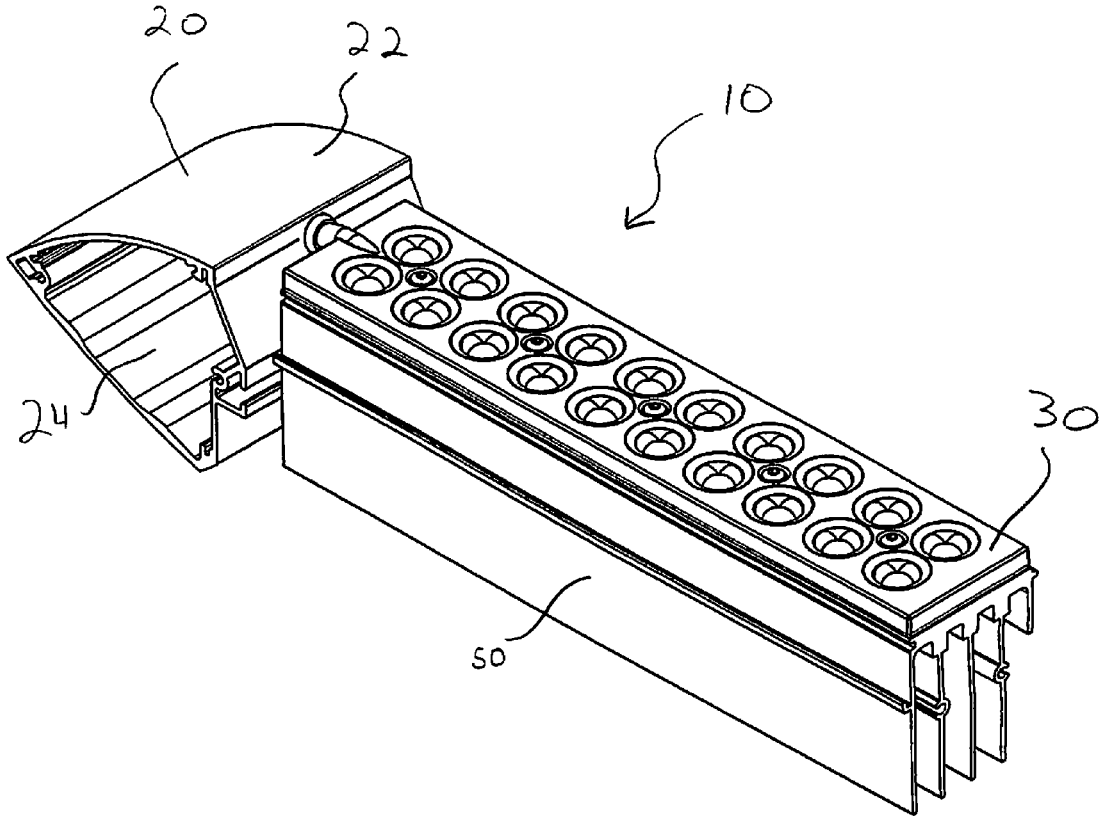
FIG. 1 is a perspective view of a preferred embodiment of the LED light fixture.

FIG. 1 illustrates a preferred embodiment of an LED light fixture 10. The light fixture 10 includes a housing 20, an LED module 30, a heat sink 50 and a rigid wireway 60.

Figure 2:
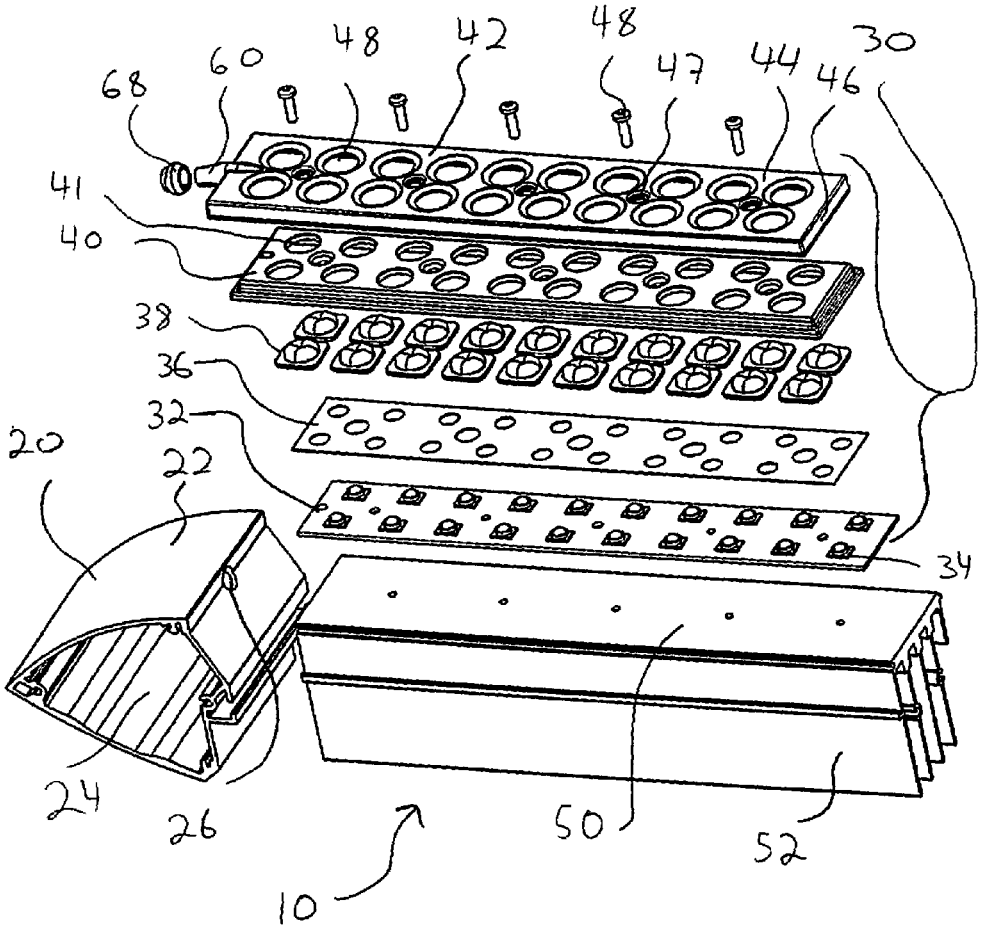
FIG. 2 is an exploded view of the LED light fixture of FIG. 1.
Figure 3:
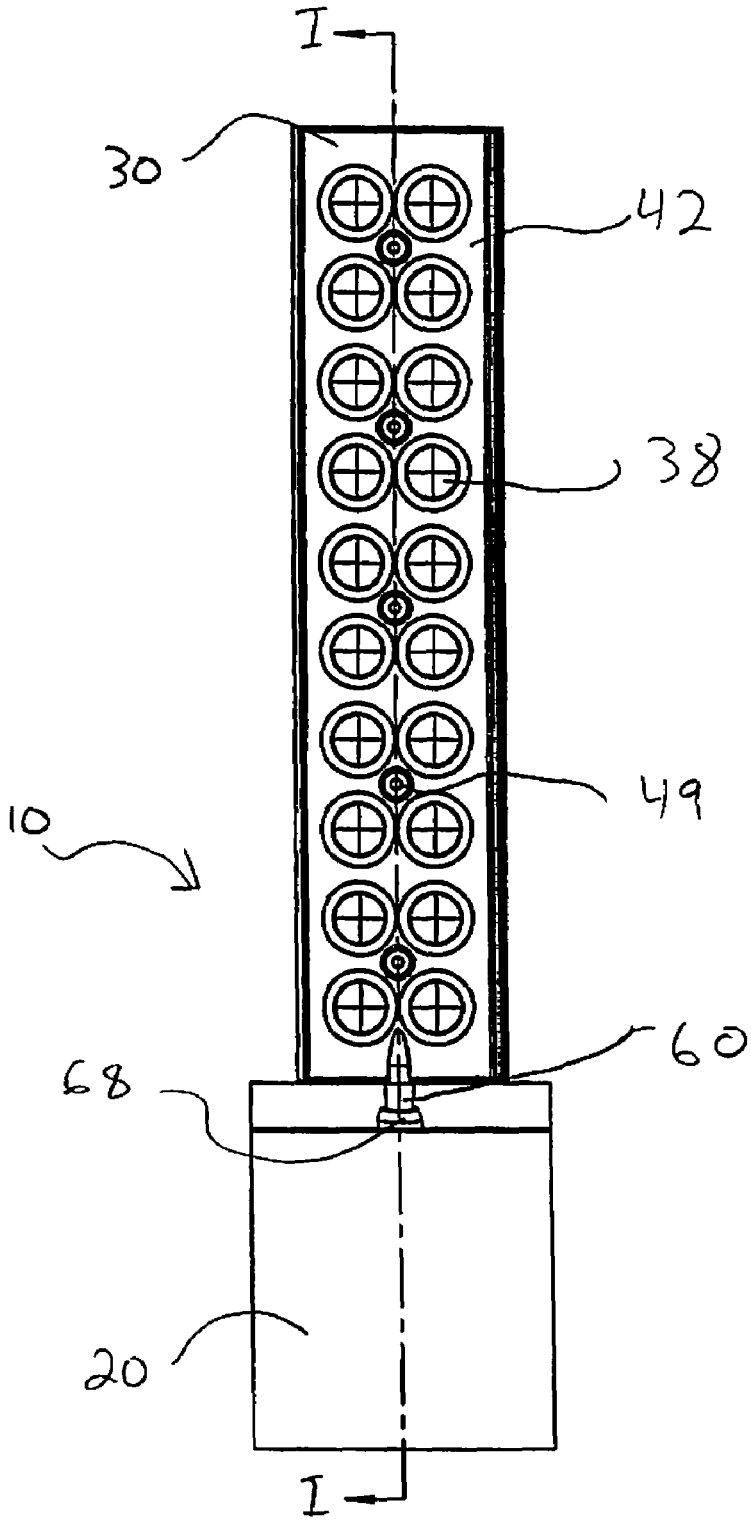
FIG. 3 is top view of the LED light fixture of FIG. 1

As best seen in FIG. 2, the LED module 30 is comprised of a plurality of layers. The base layer is the mounting board 32 which includes a plurality of LED packages 34 which are the light sources of the light fixture 10. The packages 34 are interconnected by circuits (not shown) and the mounting board 32 further includes wires (not shown) which extend from the end of the mounting board 32 closest to the housing 20.

The LED module 30 further includes an aluminum layer 36 which covers the exposed circuits on the mounting board 32. In this preferred embodiment, secondary lenses 38 cover the LED packages 34 and may help to control the manner in which light is emitted from the light fixture 10. Next, a gasket layer 40, which, in this embodiment is a sponge gasket, is disposed over the secondary lenses 38 and includes openings 41 to fit around the LED packages 34 and secondary lenses 38 in order to expose the LEDs.

Finally, the cover 42 includes a main planar portion 44 and a edge portion 46 around the main planer portion 44 and extending toward the mounting board 32. The cover 42 further includes screw holes 47 and LED holes 48. When placed together, the cover 42 and the mounting board 32 form a module interior in which the other layers of the LED module 30 fit. Screws 49 are used to secure the LED module 30 together.

A heat sink 50 is also connected to the LED module 30. The heat sink 50 connects to the mounting board 32 opposite the LED packages 34 and helps dissipate heat produced by the LED packages 34. The heat sink 50 includes a plurality of fins 52 extending away from the LED module 30 to provide surface area to help dissipate the heat.

The housing 20 is shown as a partial housing in the figures and includes an outer shell 22 that is water-tight and defines a chamber 24 on the inside. Furthermore, the outer shell 22 defines an aperture 26 for connection to LED module 30 through the rigid wireway 60. The chamber 24 of the housing is where the wiring for the fixture 10 passes through to the LED module 30. The water-tight nature of the housing 20 protects the wiring and any other sensitive equipment from the elements.

Figure 4:
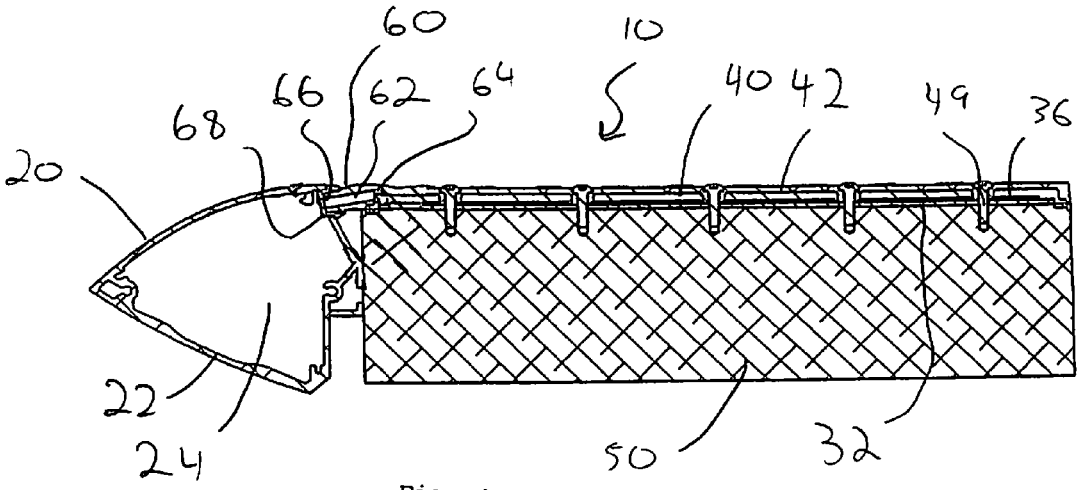
FIG. 4 sectional view of the LED light fixture of FIG. 3 taken along the line I-I.
Figure 5:
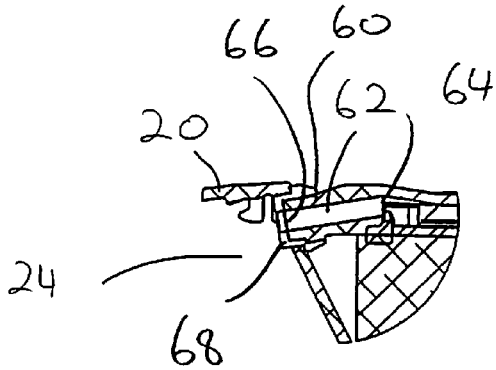
FIG. 5 is an enlarged sectional view of interaction between the housing, LED module and rigid wireway of FIG. 4.

The rigid wireway 60, the best seen in FIGS. 4 and 5, interconnects the housing 20 and the LED module 30. In this preferred embodiment the rigid wireway 60 is tube-shaped and defines a passageway 62. The wireway 60 is preferably made of metal and its rigid nature provides a secure and strong internal passageway 62 for wiring for the light fixture 10. The wireway 60 includes a proximal end 64 attached to the LED module 30 and a distal end 66 connecting to the housing 20. In this preferred embodiment the proximal end 64 is integral with the cover 42 of the LED module 30 and therefore provides a water-tight seal with the LED module 30. A seal 68 is placed between the distal end 66 and the housing 20 to provide a water-tight seal between the pieces. This combination of seals and integral pieces provides a continuous sealed environment between the interior of the LED module 30 and the housing 20. Because of sealed environment smaller gauge wires can be used to extend from the mounting board 32 through the wireway 60 and into the housing 20.

While the principles of the invention have been shown and described in connection with specific embodiments, it is to be understood that such embodiments are by way of example and are not limiting.

The invention claimed is:

1. In an LED light fixture including (a) a housing defining a chamber and including an aperture, (b) an LED module outside the chamber and adjacent to the housing and including (b1) a mounting board with a plurality of LED packages mounted thereon and (b2) a cover over the mounting board, forming a module interior and configured to expose the LED packages, the improvement comprising a rigid wireway between the LED module and the housing and defining a passageway between the module interior and the chamber, said rigid wireway including a distal end in sealing engagement about said aperture.

2. The LED light fixture of claim 1 wherein the rigid wireway is integral with the LED module.

3. The LED light fixture of claim 1 wherein the rigid wireway is integral with the cover.

4. The LED light fixture of claim 1 wherein the passageway between the interior and the chamber is water-tight.

5. The LED light fixture of claim 4 wherein the rigid wireway is integral with the LED module.

6. The LED light fixture of claim 5 wherein the rigid wireway is integral with the cover.

7. The LED light fixture of claim 6 wherein the cover includes a main planar Portion and an edge portion therearound and extending toward the mounting board, the integrally-formed rigid wireway extending from the edge portion toward the housing.

8. The LED light fixture of claim 1 further including a gasket layer disposed within the module interior and being configured to expose the LED packages.

9. The LED light fixture of claim 8 wherein the gasket layer is a sponge gasket.

* * * * *

UNITED STATES PATENT AND TRADEMARK OFFICE

CERTIFICATE OF CORRECTION

PATENT NO. : 7,566,147 B2
APPLICATION NO. : 11/744750
DATED : July 28, 2009
INVENTOR(S) : Wilcox et al.

It is certified that error appears in the above-identified patent and that said Letters Patent is hereby corrected as shown below:

In column 2, line 33, after "is" insert -- a --.

In column 2, line 64, delete "a" and insert -- an --.

In column 4, claim 7, line 28, delete "Portion" and insert -- portion --.

Signed and Sealed this

Twentieth Day of October, 2009

David J. Kappos

David J. Kappos
*Director of the United States Patent and Trademark Office*